US007465693B2

(12) United States Patent
Greer et al.

(10) Patent No.: US 7,465,693 B2
(45) Date of Patent: Dec. 16, 2008

(54) THERMOCHROMATIC TEMPERATURE MARKING FOR OUTDOOR SURFACES

(75) Inventors: Robert F. Greer, Lexington, NC (US); Alexander F. Cady, Greensboro, NC (US)

(73) Assignee: Flint Trading, Inc., Thomasville, NC (US)

( * ) Notice: Subject to any disclaimer, the term of this patent is extended or adjusted under 35 U.S.C. 154(b) by 20 days.

(21) Appl. No.: 11/520,237

(22) Filed: Sep. 13, 2006

(65) Prior Publication Data

US 2008/0060242 A1 Mar. 13, 2008

(51) Int. Cl.
*B41M 5/20* (2006.01)
*B41M 5/24* (2006.01)

(52) U.S. Cl. ..... 503/200; 404/9; 404/12; 404/14; 427/146; 428/41.7; 428/42.1; 503/201

(58) Field of Classification Search ..... 503/200, 503/201; 427/146; 428/41.7, 42.1; 404/9, 404/12, 14
See application file for complete search history.

(56) References Cited

U.S. PATENT DOCUMENTS

| | | | |
|---|---|---|---|
| 3,633,425 | A | 1/1972 | Sanford |
| 3,826,141 | A | 7/1974 | Pickett et al. |
| 3,963,442 | A | 6/1976 | Bullard et al. |
| 3,974,317 | A | 8/1976 | Sharpless |
| 4,070,912 | A | 1/1978 | McNaughtan et al. |
| 4,391,662 | A | 7/1983 | Mauthe |
| 4,433,637 | A | 2/1984 | Buirley et al. |
| 4,524,778 | A | 6/1985 | Brown, Jr. et al. |
| 4,682,605 | A | 7/1987 | Hoffman |
| 4,732,810 | A | 3/1988 | Kito et al. |
| 5,073,715 | A | 12/1991 | Kissel |
| 5,085,801 | A | 2/1992 | Thierry et al. |
| 5,464,893 | A | 11/1995 | Archey et al. |

(Continued)

FOREIGN PATENT DOCUMENTS

| | | | |
|---|---|---|---|
| GB | 2395910 | A1 | 6/2004 |

(Continued)

OTHER PUBLICATIONS http://www.halfbakery.com/idea/ICE_20Tape—Blog on why there isn't a marker for icy conditions.

(Continued)

*Primary Examiner*—Bruce H. Hess
*Assistant Examiner*—David J Joy
(74) *Attorney, Agent, or Firm*—Guerry L. Grune, Patent Manager

(57) ABSTRACT

The present invention relates to a system, method, and composition for a thermochromatic, color indicative sheet or device that is bonded to an article such as a concrete or asphalt surface, a traffic sign, a plate of a guidepost and on which is indicated a surface temperature near or below the freezing point of water. The invention can also utilize an adhesive system including a pressure sensitive adhesive (PSA) and/or thermal sensitive adhesive sheet for adhering sheets of preformed thermoplastic with the thermochromatic color indicative sheet to concrete, asphalt, wood or composite material surfaces. The invention includes methods of applying the product allowing for immediate use in a traffic area upon completion of the application to any appropriate outdoor surface.

21 Claims, 3 Drawing Sheets

U.S. PATENT DOCUMENTS

| | | | | |
|---|---|---|---|---|
| 5,482,373 | A | | 1/1996 | Hutchinson |
| 5,695,284 | A | | 12/1997 | Waters |
| 5,710,856 | A | | 1/1998 | Ishii et al. |
| 5,714,223 | A | | 2/1998 | Araki et al. |
| 5,769,563 | A | | 6/1998 | Flynn |
| 5,861,206 | A | * | 1/1999 | Jensen ..... 428/143 |
| 5,869,554 | A | | 2/1999 | Pickett et al. |
| 5,897,271 | A | * | 4/1999 | Widmer ..... 404/14 |
| 5,984,364 | A | | 11/1999 | Diamond |
| 6,030,000 | A | | 2/2000 | Diamond |
| 6,533,440 | B2 | | 3/2003 | Koyama et al. |
| 6,626,530 | B2 | | 9/2003 | Snow et al. |
| 6,633,238 | B2 | | 10/2003 | Lemelson et al. |
| 6,906,639 | B2 | | 6/2005 | Lemelson et al. |
| 6,911,917 | B2 | | 6/2005 | Higgs |
| 6,914,095 | B2 | | 7/2005 | Lorah et al. |
| 6,914,719 | B2 | | 7/2005 | Koyama et al. |
| 2002/0175881 | A1 | | 11/2002 | Luoma et al. |
| 2004/0209020 | A1 | | 10/2004 | Castiglione et al. |
| 2005/0003203 | A1 | | 1/2005 | Brown |
| 2005/0127570 | A1 | | 6/2005 | Pyles et al. |

FOREIGN PATENT DOCUMENTS

| | | | |
|---|---|---|---|
| GB | 2401710 | A1 | 11/2004 |
| JP | 52073951 | A2 | 6/1977 |
| JP | 56077191 | A2 | 6/1981 |
| JP | 60055038 | A2 | 3/1985 |
| JP | 08086079 | A2 | 4/1996 |
| JP | 10329457 | A2 | 12/1998 |
| JP | 11323708 | A2 | 11/1999 |
| JP | 2001232997 | A2 | 8/2001 |
| JP | 2001232999 | A2 | 8/2001 |
| KR | 20030080713 | A * | 10/2003 |
| WO | WO2004005372 | A1 | 1/2004 |

OTHER PUBLICATIONS http://www.executive-conference.com/conferences/archives/abstracts1999/add99_abs1a.html—regarding use of UVA and HALS for coating stabilization.

http://www.normas.com/SPE/Pages/0232.html—Plastics and Coatings: Durability, Testing By Rose Ryntz, 2001, 243 pages, Index.

http://www.bulldogproducts.com/coating/bulldogcoating.htm—Ad-Bulldog Ultra™ contains both ultraviolet absorbers (UVA's) and hindered amine light stabilizers (HALS).

Is there really such as a thing as "black ice"?, Straight Dope Science Advisory Board, Jul. 9, 2002, Staff Report. http://www.straightdope.com/mailbag/mblackice.html.

* cited by examiner

THERMOCHROMATIC TEMPERATURE MARKING FOR OUTDOOR SURFACES

FIELD OF INVENTION

The present invention relates to the use of a thermochromatic, color indicative sheet for sign markings for outdoor surfaces. In particular, the present invention relates to a thermochromatic sheet that is bonded to an article such as a concrete or asphalt surface, a traffic sign, a plate on a guidepost, etc., upon which a chromatic indicator of surface temperature on or about the freezing point of water is displayed.

BACKGROUND OF THE INVENTION

Traffic markings convey information to drivers and pedestrians by providing exposed visible, reflective, colored and/or tactile surfaces that serve as indicia. In the past, such a function was typically accomplished by painting a traffic surface. Modern marking materials offer significant advantages over paint such as dramatically increased visibility and/or reflectance, improved durability, and temporary removable marking options. Examples of modern pavement marking materials are thermoplastic, pavement marking sheet materials, tapes and raised pavement markers.

Danger exists to motorists in that changes in surface temperature may promote the formation of slippery surfaces, most notably ice. Motorists driving on roadways many times forget that bridge surfaces freeze sooner than roadways that are in contact with solid surfaces. The coefficient of friction of the roadway changes as soon as the surfaces change. (for example from roadway to bridge surface)

Black ice, also called glare ice or clear ice, is a thin layer of ice on the roadway that is created by relatively large droplets of water that slowly freeze at the freezing point of water. The larger droplets have a longer time to bond to the road or bridge surface forming a solid, icy surface.

Any ice is dangerous to drive on because it's so slippery, but black ice is especially insidious because a road covered with it looks merely wet, not icy. Black ice isn't really black, of course, but it's so thin and transparent that the dark color of the pavement shows through, and it is extremely dangerous to drive on such a surface. Statistics from Sweden show that the automobile accident rate there is five times higher on roads covered with black ice than on dry pavement, four times higher than on wet pavement, and twice that as on pavement covered with packed snow.

There is, therefore, a need for a roadway surface marking that will convey the potential for ice formation not only to alert motorists, but as advanced notification to public works crews to encourage the application of anti-icing and/or deicing materials.

DESCRIPTION OF PRIOR ART

U.S. Pat. No. 3,633,425 to Sanford, Robert A., and assigned to Meditech Energy and Environmental Corp., describe a temperature-sensing apparatus formed of a reservoir comprising a mixture of cholesteric liquid crystals, a mass of porous translucent material immersed within said mixture, and a means for fastening said reservoir to a body.

U.S. Pat. No. 3,826,141 to Pickett, et. al., and assigned to Bio-Medical Sciences, describes a temperature indicator comprising a heat conducting carrier sheet having a plurality of solid solutions of at least two organic compounds in varied composition ratios each of solid solutions melting at precise and predetermined temperatures. Also a visual indicator associated with the solid solutions comprising the incorporation of a surface-active agent selected from the group consisting of cationic, anionic and nonionic surfactants as indicators to accelerate visual indication is included.

U.S. Pat. No. 3,963,442 to Bullard, et. al., and not assigned, describes an article useful as a calorimetric indicator which comprises a first reagent composition which is reactive with a second reagent composition contained in a liquid carrier to produce an identifiable color and a solid body of a water soluble thermoplastic resin which is applied to an exposed surface of the resin and dissolves the resin at the surface without permeating the body of the resin.

U.S. Pat. No. 3,974,317 to Sharpless, Edward, and assigned to Ashley-Butler, Inc., describes a thermometric element comprising a plurality of separate compositions at least two of which have identical color arrayed in layers on an inert base, each separate composition being suitable for recording changes in temperature by a visual change in color. The element consists of a mixture containing a cholesteric liquid crystal system characterized by exhibiting color in the cholesteric state at a first temperature and changing from that state to a second state exhibiting a different color at a second fixed temperature. There is a predictable variability in a curve in which the temperature at which a visual change in color takes place.

U.S. Pat. No. 4,070,912 to McNaughton, et. al., and not assigned, describes a printable composition comprising a polymeric material dissolved in petroleum ether, the polymeric material being formed by heating a cholesteryl ester material comprising cholesteryl acetate with a thermoplastic ester of dimeric resin acid and pentaerythritol at a temperature of 150° C. until no further acetic acid is formed and the oily liquid changes to a solid.

U.S. Pat. No. 4,391,662 to Mauthe, Peter, and assigned to Hilti Aktiengesellschaft, describes a method of making adhesive connections using a thermoplastic adhesive where the thermoplastic adhesive remains above a minimum temperature required for satisfactory moistening the materials to be sealed and indicating when the temperature of the thermoplastic material falls below the minimum temperature. It also consists of a solid thermoplastic adhesive containing at least one thermochrome dye showing a color change in the temperature range between the minimum temperature necessary for satisfactory sealing and a temperature approximately 20° above the minimum temperature at which a satisfactory moistening occurs. At approximately 20° above the minimum temperature necessary for satisfactory moistening there is a color change in the thermoplastic adhesive indicating that the thermoplastic adhesive is approaching the minimum temperature necessary for sealing.

U.S. Pat. No. 4,433,637 to Buirley, et. al., and assigned to Vectra International Corp., describes a temperature measuring device for measuring the temperature of a surface comprising a flexible sheet, a coating of microencapsulated cholesteric liquid crystal material and an attached transparent sheet. The flexible sheet is engageable with a surface and conformable to the contour of a surface for transmission of thermal energy from the surface to the coating which reflects light energy in accordance with the temperature thereof and thus providing a thermal image. The composition of the coating comprises a polymeric, film-forming binder material and microcapsules having transparent wall material.

U.S. Pat. No. 4,682,605 to Hoffman, Kent, and assigned to Murray Electronics Associates Ltd., describes an apparatus for measuring and visually displaying temperature gradients over an extended temperature range as color-coded contours of constant temperature. The apparatus comprises a plurality of discrete deposits of liquid crystals sensitive in a first temperature range, a second plurality of discrete deposits of liquid crystals sensitive in a different second temperature range with the first and second pluralities of discrete deposits of liquid crystals being separate from one another but disposed in co-located respective sub-arrays on a common substrate and visually indicating a color range.

U.S. Pat. No. 4,732,810 to Kito, et. al., and assigned to Pilot Ink Co. Ltd., describes a reversible temperature-indicating composition consisting essentially of an electron-donating chromatic organic compound selected from the group consisting of diaryl phthalides, polyaryl carbinols, leuco auramines, acyl auramines, aryl auramines, Rhodamine B lactams, indolines, spiropyrans, and fluorans and a compound selected from the group consisting of phenolic compounds and an ester compound.

U.S. Pat. No. 5,085,801 to Thierry, et. al., and assigned to Centre National de la Recherche Scientifique, describes a temperature indicator for detecting whether the temperature of an article has exceeded a selected temperature threshold. It is comprised of a chemically inert substrate and deposited on the substrate at least one polydiacetylene compound exhibiting irreversible thermochromism so that the compound undergoes a change from a blue color to a red color at the selected temperature.

U.S. Pat. No. 5,464,893 to Archey, et. al., and assigned to Bayer Corp., describes a thermoplastic molding composition comprising an aromatic polycarbonate and (i) about 0.001 to 5% of a compound conforming to Y[OCHR1(CH2)n]m-Sn1-[-(-CH2)nCHR2-O]mY' wherein n1 is a whole number between 2 and 6, and where Y and Y' independently one of the other denote a hydrogen atom or a C1-40 alkyl, or C3-C5-cycloalkyl radicals or acyl radicals, a pyranyl, or silyl group, m is 0 to 70, n is 1 to 4, and R1 and R2 independently denote hydrogen C1-22 alkyl, cycloalkyl aryl, alkylaryl or cycloalkyl-aryl radicals, and (ii) 0.001 to 2% of a member selected from the group consisting of (a) aliphatic monoalcohol, cycloaliphatic monoalcohol, aliphatic polyalcohol and cycloaliphatic polyalcohol, and derivatives of said alcohols selected from the group consisting of ethers, carboxylic acid esters, acetale, alkylcarbonates, epoxides, urethanes, phosphate esters, phosphonate esters, phosphoric esters, phosphonic esters and siloxanes, said percents being relative to the weight of the composition.

U.S. Pat. No. 5,482,373 to Hutchinson, Jill; and assigned to Cool-Drink, Inc., describes a temperature indicator system for a beverage container comprising: a temperature sensing assembly being attachable to a beverage container with a temperature scale.

U.S. Pat. No. 5,695,284 to Waters, Gary; and not assigned, describes a thaw indicator unit for sensing and permanently recording a thawing event experienced by a temperature sensitive food item and a visible section having a markedly different and readily visible color from that of juxtaposed segments.

U.S. Pat. No. 5,710,856 to Ishii, et. al., and assigned to Mitsui Toatshu Chemicals, Inc., describes a light reflective sheet which comprises a porous resin sheet and a protective layer laminated on at least one surface of the porous resin sheet.

U.S. Pat. No. 5,714,223 to Araki, et. al., and assigned to 3M, describes a retroreflective article that comprises a retroreflective layer having major surfaces, a cover layer, the cover layer comprises a surface layer, an optional intermediate layer, and a back layer. The intermediate layer contains a vinylidene fluoride base polymer as a primary component, the surface layer contains a methyl methacrylate base polymer as a primary component, and the back layer contains a methyl methacrylate base polymer, and a vinylidene fluoride base polymer U.S. Pat. No. 5,869,554 to Pickett, et. al., and assigned to General Electric Co., describes a composition comprising a polycarbonate; a piperazinone based HALS; and at least one of a benzotriazole, benzophenone, triazine, oxanilide, and cyanoacrylate based UVA. It is also a composition wherein the polycarbonate comprises from about 90% to about 99.9% by weight of the total composition and the piperazinone and piperazine dione based HALS and the benzotriazole, benzophenone, triazine, oxanilide, and cyanoacrylate based UVA, taken together comprise from about 0.1% to about 10% by weight of the total composition, the ratio of the piperazinone and piperazine dione based HALS to the benzotriazole, benzophenone, triazine, oxanilide, and cyanoacrylate based UVA being from about 5:95 to about 90:10.

U.S. Pat. No. 5,984,364 to Diamond, Robert; and assigned to Diamond Security, Inc., describes a negotiable document having enhanced security for deterring generation of copies of the negotiable document, including: at least one watermark comprising a fingerprint; and a visually perceptible watermark representation for comparison with the watermark to determine validity of the negotiable document.

U.S. Pat. No. 6,030,000 to Diamond, Robert; and assigned to Diamond Security, Inc., describes a negotiable document having enhanced security for deterring fraud, including: at least one thermochromatic image printed with thermochromatic ink, wherein said thermochromatic image will fade when heat is transferred to the image from a live human hand.

U.S. Pat. No. 6,533,440 to Koyama, et. al., and assigned to Yupo Corp., describes a light reflector comprising a biaxially stretched film comprising a polyolefinic resin and a filler, wherein the filler is an inorganic filler comprising calcium carbonate having an average grain size of 0.1 to 8 μm and/or an organic filler having a mean dispersion grain size of 1.0 to 8 μm, the biaxially stretched film has an area stretched factor of 25 to 80, and the light reflector has a luminance of 1,300 $cd/m^2$ or above.

U.S. Pat. No. 6,626,530 to Snow, et. al., and assigned to DuPont, describes a process for making an article with an image protected by a clear fluoropolymer film said process comprising coating the inner surface of said fluoropolymer film with a layer of hydrophobic, ink receptive polymer. The composition uses an inkjet print head supplied with a non-aqueous solvent based ink adhering said clear fluoropolymer film whereby said image is viewable through and protected by said fluoropolymer film.

U.S. Pat. No. 6,914,095 to Lorah, et. al., and assigned to Rohm and Haas Co., describes a process for preparing an aqueous nanocomposite dispersion comprising providing an ethylenically unsaturated monomer, an aqueous clay dispersion partially exfoliated clay and a second ethylenically unsaturated monomer, to form a modified aqueous clay dispersion.

U.S. Pat. No. 6,914,719 to Koyama, et. al., and assigned to Yupo Corp., describes a light reflector formed of a biaxially-stretched film which contains a thermoplastic resin and a filler and has an opacity of at least 95%, a whiteness of at least 90%, a reflectance R0 of at least 92%, and an areal draw ratio of from 22 to 80 times.

U.S. Patent Application No. 20040209020A1 to Castiglione, et. al., and assigned to 3M, describes an assembly comprising an inert environment bounded on at least one side by a pane, wherein the pane is at least partially transparent to ultraviolet light; a structure positioned in the inert environment, the structure comprising a polymeric film and an effective amount of a ultraviolet light-absorbing compound, wherein the ultraviolet light absorbing compound comprises a triazine.

U.S. Patent Application No. 20050003203A1 to Brown, James; and assigned to Cytonix Corp., describes a composition of matter comprising the reaction product of a first monomer and a second monomer, said first monomer comprising least 15 percent by weight a trifluormethyl-containing monomer, said second monomer comprising 1 to about 10 percent by weight differing from the first monomer.

U.S. Patent Application No. 20050127570A1 to Pyles, et. al.; and not assigned, describes a method of treating a plastic article selected from thermoplastic polymer and thermoset polymer contacting at least a portion of the surface with a treatment composition comprising at least one additive selected from UV stabilizers, optical brighteners, mold release agents, antistatic agents, thermal stabilizers, IR absorbers and antimicrobial agents with a treatment composition for a period of time at least sufficient to form a treated plastic article and removing said treated plastic article from contact with said treatment composition.

U.S. Pat. No. 4,524,778 to Brown, et. al., and assigned to American Thermometer Co. Inc., describes a device for sensing and recording the skin surface temperature comprising a first flexible panel of film-like material and effective to produce a thermogram of the skin surface.

U.S. Pat. No. 5,073,715 to Kissel, Philippe, and not assigned, describes an invention concerning an optical warning system comprising both a light beam emitting device and a device for switching on and off said beams.

U.S. Pat. No. 6,911,917 to Higgs, James Robert, and assigned to Astucia Ltd., describes a hazard warning device, comprising a set of self-contained, micro-processor controlled studs each incorporating at least one rechargeable battery and/or capacitor, said studs being capable, when activated by emitting a flashing or constant hazard warning light, and adapted, when not deployed, to be housed in a charger case that is stored and transported in a road vehicle, with said battery and/or capacitor being recharged from the electrical system of said vehicle; wherein each of said studs incorporates a pair of spaced-apart pins constituting electrical contacts projecting from one side of a rectangular housing for recharging purposes.

U.S. Pat. No. 6,906,639 to Lemelson, et. al., and not assigned, describes a system for operating and controlling a motor vehicle having a power-drive system and controls including an accelerator, a brake, and a steering system comprising a ranging device directed toward the front of the vehicle and structured to generate first signals indicating the distance to and relative motion of some objects in front of the vehicle. And a detector directed away from the vehicle in a direction other than the front of the vehicle and structured to generate second signals identifying whether there is an object in said other direction; and a fuzzy logic-based computer having a memory containing a plurality of sets of fuzzy inference vehicle control rules, each rule defining a coordinated combination of changes to the vehicle's steering and acceleration wherein the computer is coupled to the ranging device and the detector and structured to use the first and second signals to select and reproduce from the memory a selected one of the plurality of sets of rules and to apply the selected set of rules to derive command signals with fuzzy logic. The computer is electrically coupled to the vehicle controls whereby the command signals are applied to control the accelerator, brake, and steering system in a coordinated way to attempt to avoid collisions between the vehicle and objects in its path of travel without taking evasive action that would cause a collision with objects detected in said other direction.

U.S. Pat. No. 6,633,238 to Lemelson, et. al., and not assigned, describes a method of using at least one central controller and at least one intelligent controller for controlling traffic and traffic lights and selectively distributing warning messages to motorists comprising the acts of obtaining traffic information from various traffic information units, transmitting the traffic information to at least one central controller, using the central controller to determine congestion parameters and warning information, transmitting the congestion parameters and the warning information from the at least one central controller to the intelligent controller, and using the intelligent controllers to determine appropriate action based on the congestion parameters and the warning information.

U.S. Pat. No. 5,769,563 to Flynn, Gregory, and not assigned, describes a portable highway warning device comprising a flexible resilient mat having a substantially flat lower surface and an upper surface, said mat having an elongated rectangular periphery, said mat having an undulated surface defined by a plurality of wave crests and a plurality of wave troughs positioned between said wave crests, said mat and said upper surface produces a discernible audible sound and a discernible vibration to the vehicle operator.

U.S. Patent Application No. 20020175881A1, to Luoma, et. al., and not assigned, describes a method of making a mobile sign for temporary placement along roadways for directing messages to vehicular traffic on said roadways, arranging a multiplicity of light emitting diodes in at least one matrix and orienting each light emitting diodes in a common direction.

Great Britain Patent Application No GB2395910A1, to Wymer, Susan, and assigned to National Wheat Bag Co. Ltd., describes a bag adapted to be filled with stuffing material, the bag comprising at least a region adapted to change colour upon exposure to a temperature variation. The bag may be made of textile and the stuffing material may be wheat, barley, rice, corn or foam. The regions change colour on sensing a temperature variation from a first (lower) temperature to a second (higher) temperature. The region may comprise thermochromatic ink or dye which changes colour when exposed to the temperature variation.

Great Britain Patent Application No GB2401710A1, to Salvage, Richard, and not assigned, describes a thermal warning device for a door comprising a thermochromic indicator adapted to display a warning when the temperature at the surface of the door exceed a predetermined level indicative of fire. The thermochromic indicator warns of the presence of fire by changing colour and/or by displaying a warning message or symbol. The thermochromic layer may be formed using a thermochromatic ink, in particular a luminescent thermochromatic ink.

Japanese Patent Application No JP08086079A2, to Kawachi, et. al., and assigned to Chugoku Marine Paints Inc., describes a composition that temperature-sensing micro-capsules layer is formed made up of a temperature-sensing agent, in which the color development and the color disappearance are generated by the change of a state due to a temperature desensitizer in the presence of a developer at that time. A warm color hue is displayed at a temperature of 10° C. or lower, a hue feeling the cool feeling of a cold color is displayed at the time of a high temperature for a summer period of 30° C. or higher, and a reversible change is performed easily.

Japanese Patent Application No JP10329457A2, to Eto et. al., and assigned to Toppan Forms Co. Ltd., describes a thermal transfer ribbon wherein at a certain temperature reveals a prior invisible message. The thermal transfer layer comprises a heat-fusible wax and/or a thermoplastic resin in which a microcapsule containing a temperature-indicating agent is dispersed, on the base material surface. The heat-fusible wax to be used after properly selecting it is paraffin wax or carnauba wax. The thermoplastic resin to be used after properly selecting it is polyethylene or polyvinyl acetate. The temperature-indicating agent is a thermochromatic material such as a metamorcolor or a liquid crystal which reversibly shows development, decoloration or discoloration due to temperature change.

Japanese Patent Application No JP11323708A2, to Ishimura, Aoya, and assigned to Pilot Ink Co. Ltd., describes a reversibly thermally color-changeable braid having a microencapsulated pigment including a reversibly thermally color-changeable composition consisting of a homogeneously compatibilized mixture comprising an electron-donating and coloring organic compound, an electron-accepting compound and a reaction medium determining the temperature inducing the color reaction between components. The braid is melt-blended at 0.1-30 pts.wt. in 100 pts.wt. of a thermoplastic resin, and the resulting blend is then melt-spun using a melt spinning unit to produce a reversibly thermally color-changeable yarn 10-300 μm in outer diameter; subsequently, the yarn is braided using a braider for circular braid.

Japanese Patent Application No JP2001232997A2, to Nakatani, et. al., and assigned to Shinzen:K K, describes a transfer paper usable under high temperature and high humidity environment containing a fluororesin and a UVA and/or an HALS is used.

Japanese Patent Application No JP2001232999A2, to Nakatani, et. al., and assigned to Shinzen:K K, describes a method for improving light resistance and weatherability and stabilizing properties of a transferred picture pattern. The light resistance and the weatherability are improved by a method wherein an image is formed on a transfer sheet by means of an image forming apparatus and a copied transfer sheet is immersed in a UVA/HALS organic solvent solution and then, transfer is performed or the organic solvent solution is sprayed on the transferred image and then, UVA and HALS is made to permeate into the picture pattern toner layer.

Japanese Patent Application No JP52073951A2, to Goto, et. al., and assigned to Nippon Zeon Co. Ltd., describes incorporation of a dicycloalkyl phenol in a thermoplastic resin providing a composition capable of reversible color change by the action of sunlight or heat and also resistant to thermal or oxidative deterioration.

Japanese Patent Application No JP56077191A2, to Hachitani, et. al., and assigned to Toyo Ink Co. Ltd., describes a composition having excellent long period stability, storage stability, sharp color change property and capable of being applied to both dry heating and wet heating as well as suitable as a temperature displaying and a heat sensing paint and ink. (A) A compound of a metal selected from cobalt, nickel, molybdenum and lead (e.g.; cobalt carbonate, lead acetate or nickel stearate) and (B) thiourea or thiourea derivatives (e.g.; 1,1-diethyl-2-thiourea or the like) are compounded to for am objective composition. Moreover, a compounding ratio of the component (A) and (B) is preferably regulated to A:B=: 2W2:1 in a wt. ratio. Further, if the composition is dispersed in a binder having a coating forming capacity (e.g.; nitrocellulose or a vinyl chloride-vinyl acetate copolymer), the obtained dispersion can be used a coating agent such as a paint or an ink.

Japanese Patent Application No JP60055038A2, to Uchiyama, Hiroshi, and assigned to IIC Kagaku Kogyo K K, describes a composition which rapidly changes its color reversibly by light and gives a large contrast with respect to the color change, by blending bis-[2-(p-methoxy)phenyl-4,5-diphenyl imidazolyl] with a thermoplastic resin. When the compound is exposed to sunlight, its color changes from water-whiteness to deep blue, while when light is screened, its color rapidly reverts to water-whiteness.

Korean Patent Application No KR3080713A, to Choi, et. al., and assigned to Q-SYS o. Ltd., describes a reactive urethane acrylate having ultraviolet absorbent (UVA) functional group and hindered amine (HALS) group simultaneously, preparation thereof and photocurable resin composition containing the same.

PCT Patent Application No. WO04005372A1, to Pickett, et. al., and assigned to General Electric Co., describes polycarbonate structural units derived from at least one dihydric phenol, a carbonate precursor, and at least one member selected from the group consisting of an oxanilide-comprising compound, an oxamate—comprising compound, and mixtures thereof.

It is therefore desirable to have a thermochromatic, color indicative sheet or device that is bonded to an article such as a concrete or asphalt surface, a traffic sign, a plate of a guidepost and on which is indicated a surface temperature near or below the freezing point of water.

DETAILED DESCRIPTION OF THE DRAWINGS

Figure 1:
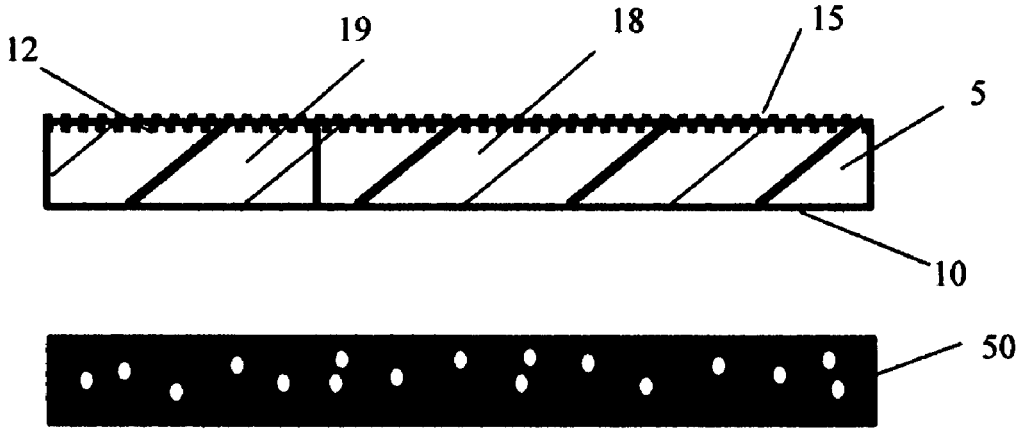
FIG. 1 is a cross-sectional view of a pre-formed thermochromatic thermoplastic sheet with a surface layer marking that is adhered directly to the substrate with or without the use of a sealer.

FIG. 1 is a cross sectional view of a preformed thermochromatic thermoplastic sheet [5] which includes a bottom side [10] and a top side [12] that preferably has an aggregate [15] embedded in the top side [12] along with a patterned display or marker. The preformed thermochromatic thermoplastic sheet [5] is comprised of various thermoplastic formulations in specific patterns which can both change colors and hue intensity in response to temperature changes. The preformed thermochromatic thermoplastic sheet [5] may be comprised of multiple segments such as segment A [19] and segment B [18] that may be abutted or adjacent to additional segments. The preformed thermochromatic thermoplastic sheet [5] contacts the application surface [50], such as a bituminous or Portland concrete/cement surface, to provide permanent pedestrian and traffic control markings directly and is adhered to the application surface [50] without the use of a sealer. Heat, preferably from about 400 degrees F. to about 425 degrees F., may be used to aid in adhesion by melting the preformed thermochromatic thermoplastic sheet [5] directly to the application surface [50].

In another embodiment, adhesion to the application surface of the preformed thermochromatic thermoplastic sheet [5] is accomplished with a polyurea epoxy primer in a one or two-step operation such as adding a primer to the application surface [50], applying the preformed thermochromatic thermoplastic sheet [5] and heating or adding a primer to the application surface [50], applying the preformed thermochromatic thermoplastic sheet [5] and reheating both the preformed thermochromatic thermoplastic sheet [5] and the application surface [50].

Figure 2:
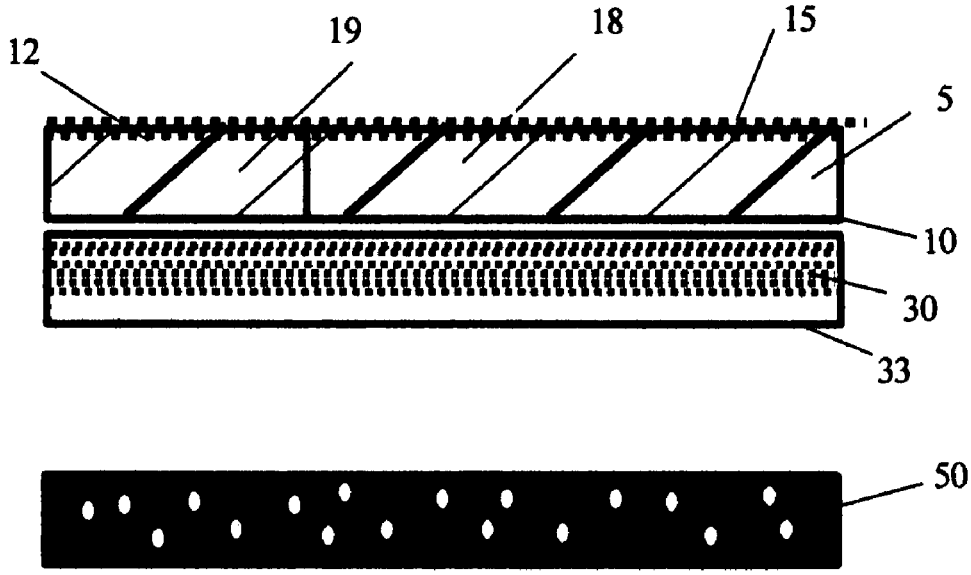
FIG. 2 is a cross-sectional view of a pre-formed thermochromatic thermoplastic sheet with an adhesive composition integrally attached to the thermochromatic thermoplastic sheet with or without the use of sealer.

FIG. 2 is a cross section view of a preformed thermochromatic thermoplastic sheet [5] adhered to an adhesive [30] of a high content binder formulation with a surface adhesive side [33] readily attachable to the application surface [50]. The surface adhesive side [33] contacts the application surface [50] forming an adhesive bond. Alternatively the application surface side adhesive side [33] may be an epoxy sealer which contacts the application surface [50] forming an adhesive bond and sealant where heat may be applied.

Figure 3:
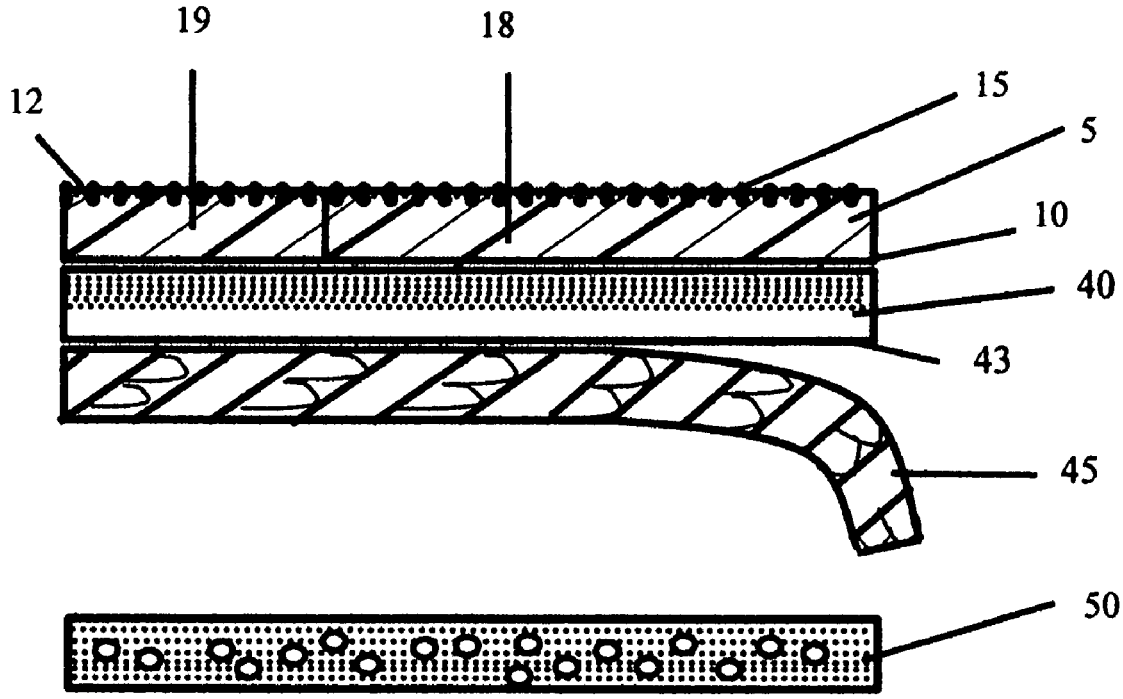
FIG. 3 is a cross-sectional view of a pre-formed thermochromatic thermoplastic sheet with a protective sheet and pressure sensitive adhesive composition integrally attached to the thermochromatic thermoplastic sheet with or without the use of sealer.

FIG. 3 is a cross sectional view of a preformed thermochromatic thermoplastic sheet [5] which includes a bottom side [10] and a top side [12] that preferably has an aggregate [15] embedded in the top side [12] along with a patterned display or marker. The preformed thermochromatic thermoplastic sheet [5] may be comprised of multiple segments such as segment A [19] and segment B [18] that may be abutted or adjacent to additional segments. The pressure sensitive adhesive [40] is in intimate contact with the preformed thermochromatic thermoplastic sheet [5] and a protective sheet [45] is removably adhered to the pressure sensitive adhesive [40] surface adhesive side [43]. The preformed thermochromatic thermoplastic sheet [5] is then moved to the application surface [50] at the desired location and the protective sheet [45] is peeled away to expose the surface adhesive side [43] to the application surface [50]. The surface adhesive side [43] thus contacts the application surface [50] forming an adhesive bond which is strengthened by application of pressure to the top surface [15].

Figure 4A:
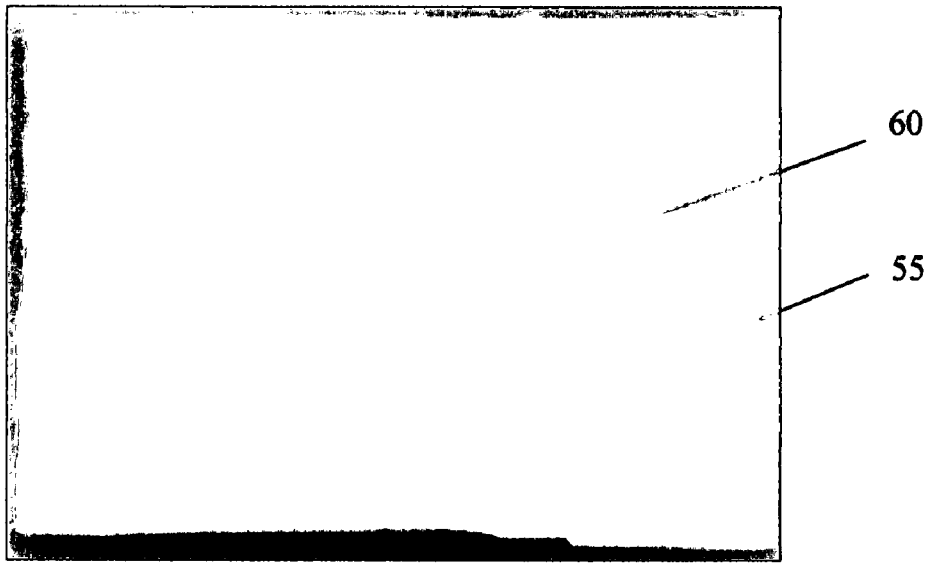
FIG. 4A and FIG. 4 B are photographs of an actual thermochromatic surface in a working example of the inventive article illustrating the difference between sub-freezing (FIG. 4B) and above freezing (FIG. 4A) ambient temperature conditions.
Figure 4B:
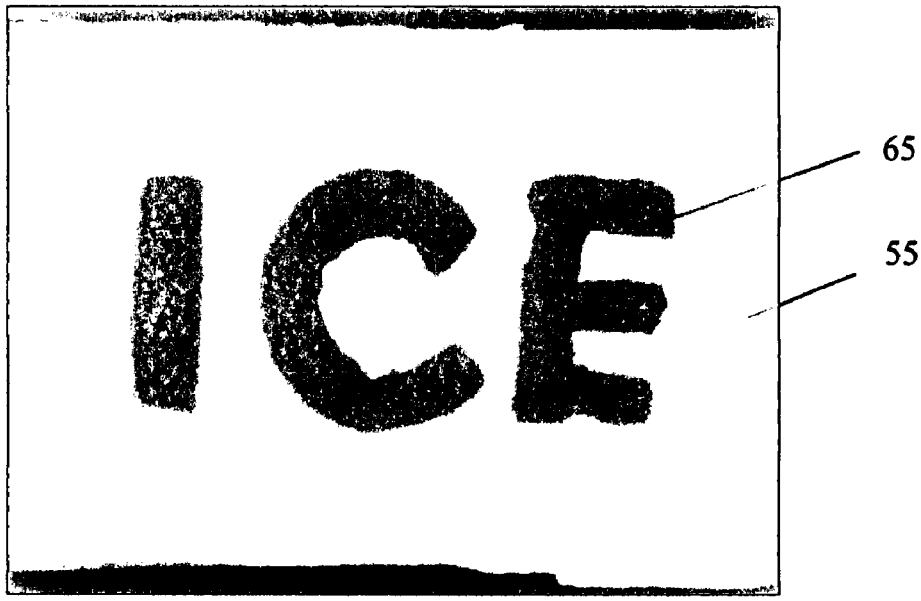

FIG. 4A and FIG. 4B are photographs of an actual preformed thermochromatic thermoplastic sheet [5] top side [12] surface as a working example of an embodiment illustrating the surface [12] difference between above freezing (FIG. 4A) and sub-freezing (FIG. 4B) ambient temperatures. The surface temperature of the thermochromatic sheet is the temperature which is sensed and causes the indication.

As shown in FIG. 4A, the preformed thermochromatic thermoplastic sheet [5] retains an thermochromatic thermoplastic image [60] in a similar color, hue or tone as the surrounding non-thermochromatic thermoplastic area [55] when the temperature is above freezing (at or above 32 deg F. or 0 deg C.).

In FIG. 4B, an ambient temperature of 32 deg F. or 0 deg C. or below causes the thermochromatic thermoplastic image [60] to change color, hue or tone such that a detectable image [65] is easily seen in contrast to the surrounding non-thermochromatic thermoplastic area [55].

SUMMARY OF INVENTION

One embodiment of the present invention provides for a thermochromatic, color indicative sheet or device that can be directly bonded to an article such as a concrete or asphalt surface, a traffic sign, or a plate of a guidepost and on which can be indicated a surface temperature near or below the freezing point of water. This preformed thermochromatic road marking material includes the use of Thermochromatic Pigment Black Type-5 with 0 degrees Celsius color transition obtained from United Polymer Technology, LLC of Akron, Ohio. This product, with the special pigment produces a color change at a specified temperature (in this case at freezing—or 0 Celsius). The thermochromatic pigment can be used in concentrations of 1% to 20%, with the preferred formulation at or about 4%. A sealer may be used over the concrete or asphalt surface prior to adhesion of the thermochromatic sheet.

A second embodiment includes the use of an adhesive layer that may be heated with an appropriate heating system such that the adhesive layer enters a molten state on any appropriate surface (such as concrete or asphalt) prior to application of the thermochromatic marking surface directly over the molten adhesive layer. Again, the option to seal the surface prior to applying the adhesive layer exists.

A third embodiment of the present invention relates to a method for adhering the thermochromatic sheets that are hydrocarbon or alkyd thermoplastic in nature (generally known as thermoplastic signage) to an uncured concrete traffic surface to provide permanent pedestrian and traffic control markings. Traffic signage may be applied using this method preferably from about 24 hours to about 48 hours after pouring or shaping, although in many cases concrete may remain moist for longer periods due to the moisture content of the surrounding soil. For this embodiment there is no need for preheating of the pavement, or removal of laitance on portland cement concrete. The concrete or asphalt surface also may be sealed using this technique.

The third embodiment utilizes a low viscosity polyurea composition from about 100 centipoise to about 300 centipoise which allows rapid penetration into the pores of uncured concrete substrate surfaces. Without being bound by any particular theory, polyurea of the specified viscosity appears to penetrate through the moisture into the concrete substrate before curing.

The curative systems may also include amine-terminated chain extenders in the formulation. Suitable chain extenders include, but are not necessarily limited to aliphatic, aromatic and cycloaliphatic diamine chain extenders.

In addition to polyurea compositions, other curable systems of a sufficiently low viscosity to penetrate the concrete surface are selected from the group comprising one- and two-part epoxies, multi-component polyurethanes, silicone adhesives, UV/EB curable adhesives, UV/EB curable resins and combinations thereof.

All Portland cements are hydraulic cements that set and harden through a chemical reaction with water. During this reaction, called hydration, a node forms on the surface of each cement particle. The node grows and expands until it links up with nodes from other cement particles or adheres to adjacent aggregates.

It is during hydration that an applied low viscosity polyurea seeps into and is chemically reactively bonded to the concrete. An adhesive, thermoplastic, or preformed thermoplastic sheeting is placed over the polyurea/concrete substrate and heated to where the adhesive sheeting melts into the polyurea/concrete substrate becoming a semi-homogeneous mixture. The thermochromatic signage can then be applied and smoothed or leveled over the semi-homogeneous mixture and can then be heated to a temperature to melt the thermoplastic material into the semi-homogeneous mixture, thereby creating a chemically reacted bonded layered product.

Heating of the surface of the thermochromatic signage and the adhesive layer may be accomplished by a heating means such as the FLINT 2000EX® heat gun, manufactured by Flint Trading, Inc., or can be accomplished with an open flame, a closed flame, by heated roller, electrically resistive heating or other means known to those skilled in the art.

The heat source is then removed from the thermoplastic signage and the mixture is allowed to cool thereby returning the mixture from a molten state to a semi-molten state and finally to a hardened state as one substance that includes the concrete substrate.

The re-application of heat, useful in particular, to bond the thermochromatic signage edges, will allow the edges to flow penetrating into the semi-homogeneous mixture and into the concrete providing stability toward mechanical damage (such as plows) and edge peeling.

The application of cool water after a heated state will hasten solidification, strengthening and curing of the mixture.

An additional embodiment of the present invention also relates to a system, method, and composition utilizing a pressure sensitive adhesive (PSA) and/or thermal sensitive adhesive sheet for adhering sheets of preformed decorative thermoplastic road markings combined with the thermochromatic color indicative sheet. The present invention includes achieving sufficient adhesion without requiring the use of specialized tools.

The preformed thermoplastic or thermoset may be alkyd or hydrocarbon based and includes a PSA (pressure sensitive adhesive) with one surface in contact with the thermoplastic sheet and the second side or surface correspondingly to be placed in contact with the concrete, asphalt, wooden or composite material surface.

In order to achieve semi-permanent or permanent adhesion of the pre-cut thermoplastic thermochromatic color indicating sheet, the typical user must purchase or rent a heating device of sufficient heat volume or contract with a business possessing specialized heating tools required.

It is therefore another object of the invention to provide a thermoplastic thermochromatic, color indicative sheet or device that may be applied without the requirement or use of specialized (heating or other) tools. The present invention describes a system, method and composition for creating, adhering and installing a preformed thermoplastic thermochromatic, color indicative sheet or device to a surface utilizing a pressure sensitive adhesive (PSA) without requiring the use of specialized tools.

Additionally, the present invention relates to a system, method and composition for utilizing an emulsion based, solid, single component, multiple component, or radiation curable pressure adhesive sheet composition that may require energy activation for adhering thermoplastic or preformed thermoplastic thermochromatic, color indicative sheet or device to various surfaces. One embodiment includes preferably, a PSA that is based on butyl moieties for the adhesion chemistry with a silicon sheet on one or both sides of the PSA composition.

The thermochromatic, color indicative sheet or device markings associated with the top surface of the preformed thermoplastic or thermoset sheets may be decorative or legend type markings or road indicia or the like.

DETAILED DESCRIPTION OF THE INVENTION

One embodiment of the present invention relates to a system, method and a composition for adhering preformed thermoplastics that are hydrocarbon or alkyd based thermoplastics or thermosets with thermochromatic surfaces utilizing a pressure sensitive adhesive (PSA).

Such an embodiment of the present invention is described in terms of installation and implementation, with the following instructions for manufacturing and application using a pressure sensitive adhesive system;

Manufacturing instructions:

a) Start with a preformed thermoplastic thermochromatic, color indicative sheet or device of the current invention.

b) Cut the preformed sheet into decorative segments.

c) Apply PSA silicon based sheets on one or both sides.

d) Place segments adjacent to each other to form decorative/predetermined patterns.

e) Join segments with PSA into one or several manageable pieces.

f) Ship manageable pieces to the application site (and application surface where adhesion is required).

Application instructions for the present invention:

Pressure Sensitive Preformed Thermochromatic Surfacing & Marking Material

General Information

ReadyMark™ is a durable horizontal and vertical surface overlay material suitable for horizontal signage, logos, slip proofing, and decorative surfacing of walkways, light traffic roadways, access routes, ramps, etc., located near on within residential and commercial buildings and facilities such as schools, hospitals, shopping malls, airports, bus terminals, train stations, etc. The material is equally suitable for concrete, asphalt, metal, glass, and plastic surfaces. ReadyMark™ consists of a solid sheet or a pattern of interconnected individual pieces of preformed thermoplastic material mounted on a sheet of pressure sensitive adhesive with a peel-off liner. The application procedure requires the use of a tamping roller, such as the use of the ReadyMark™ Roller. ReadyMark™ provides a wear-resistant, non-skid/non-slip, durable surface that can be used in traffic areas immediately after application is completed. The present invention utilizes a ReadyMark™ like backing, however, in this case, a thermochromatic, color indicative sheet is used as the top surface for indicating climate information.

Installation requirements are essentially identical to ReadyMark™ requirements as outlined below, but with the caveat that the top thermochromatic, color indicative sheet or device surface requires special attention and is used for bonding to an article such as a concrete or asphalt surface, a traffic sign, or a plate of a guidepost and on which is indicated a surface temperature near or below the freezing point of water. This preformed thermochromatic road marking material includes the use of Thermochromatic Pigment Black Type-5 with 0 C color transition obtained from United Polymer Technology, LLC of Akron, Ohio. This product, with the special pigment produces a color change at a specified temperature (in this case at freezing—or 0 Celsius). The thermochromatic pigment can be used in concentrations of 1% to 20%, with the preferred formulation at or about 4%.

General Requirements

The list of requirements below are provided to the user and are necessary to insure proper installation and longevity of the ReadyMark™ product with the addition of the thermochromatic top sheet.

Moisture: It is important to ensure that no surface moisture is present prior to applying ReadyMark™ or ReadyMark™ Sealer to the application surface. The presence of moisture can be mitigated by taping a segment of dark plastic sheeting, approximately 18 in.×18 in., tightly to the surface, making sure that all edges are sealed with duct tape. A plastic sheet should be applied in an area where it is exposed to sunlight. After 20-30 minutes it is possible to get an early indication of the presence of moisture by lifting a corner of the plastic sheet and visually inspecting it for any moisture that may have accumulated on the underside of the sheet. FIG. 1 provides a visual rendition of this task. If no moisture is present, proceed to the second section entitled "Surface" below. If moisture is present the application should be completed at a later time when the surface is moisture free. It is not advisable to apply ReadyMark™ if a rainfall/spill has occurred within 24 hours or if the ambient humidity is greater than 80%.

Surface: The application surface must be free of dirt, dust, chemicals and significantly oily substances. Concrete must be free of curing compounds and laitance. ReadyMark™ can be applied directly on very smooth clean surfaces (glazed ceramic tile, polished concrete, smooth metal, polished granite, etc.). On all other surfaces such as regular concrete, asphalt, granite, etc., ReadyMark™ Sealer must be applied before applying the ReadyMark™ material. It is not recommended to apply ReadyMark™ on top of top of paint, thermoplastic, cold plastic, or other types of floor surfacing materials and pavement coatings. The surface and ambient air temperature must be at least 50° F.

Material: ReadyMark™ shall be kept dry at all times—in storage, in transit and on the project. Avoid extreme storage temperatures. ReadyMark™ should be stored in a building that is between 35° F. and 90° F. The packages should be stored flat and stacked a maximum of 25 packs high. The expected minimum shelf life for this product is 12 months.

Safety Precautions

ReadyMark™ Sealer is highly flammable. Skin and eye contact with the ReadyMark™ Sealer should be avoided by wearing protective equipment necessary including eye, and hand protection. Keep containers tightly sealed when not in use. The sealer should be kept out of the reach of children.

Application Procedure

The application area should be thoroughly cleaned. All loose particles, sand, dust, etc. must be removed. Utilize a power blower or compressed air if available, otherwise sweeping the surface completely clean should be adequate.

Ensure that no moisture is present. See "Moisture" under General Requirements (above).

All of the foregoing set of instructions and procedures should be used to provide a thermochromatic top sheet together with the ReadyMark™ adhesive system.

What is claimed is:

1. A roadway marker with a thermochromatic surface comprising;

at least two preformed thermoplastic segment(s) that include top sides and bottom sides wherein said thermochromatic surface is attached to said top sides and wherein said bottom side either includes an adhesive layer or no adhesive layer on a bottom side of said thermoplastic segment(s), and wherein said sheeting is subsequently attached to a substrate.

2. The marker of claim 1, wherein said thermochromatic surface has a visible detectable image when the temperature is near or below the freezing point of water.

3. The marker of claim 1, wherein preformed thermochromatic road marking material is used for said thermochromatic sheet, wherein said sheet is color indicating and comprises a thermochromatic pigment with a color transition at zero degrees Celsius, therein producing a color change near or below the freezing point of water.

4. The marker of claim 3, wherein said thermochromatic pigment is used in concentrations of 1% to 20%.

5. The marker of claim 4, wherein said thermochromatic pigment is used at a concentration of 4%.

6. The marker of claim 1, wherein said marker comprises more than one preformed thermoplastic segment which can be matched with at least one other preformed thermoplastic segment such that said thermochromatic surface layer provides a desired pattern.

7. A method for providing a roadway marker with a thermochromatic surface comprising;

providing at least two preformed thermoplastic segment(s) that include top sides and bottom sides wherein said thermochromatic surface is attached to said top sides and wherein said bottom side either includes an adhesive layer or no adhesive layer on a bottom side of said thermoplastic segment(s), and wherein attaching said sheeting to a substrate is accomplished by pressure, heat, or any useful form and combination of heat and or pressure.

8. The method of claim 7, wherein a detectable image is visualized within said thermochromatic surface when the temperature is near or below the freezing point of water.

9. The method of claim 7, wherein said thermochromatic sheet indicates a tone, hue or color and comprises a thermochromatic pigment with a color transition at zero degrees Celsius, therein producing a color change near or below the freezing point of water.

10. The method of claim 7, wherein said thermochromatic sheet contains pigment in concentrations of 1% to 20%.

11. The method of claim 10, wherein said thermochromatic sheet contains pigment at a concentration of 4%.

12. The method of claim 7, wherein producing said roadway marker comprises more than one preformed thermoplastic segment(s) matching with at least one other preformed thermoplastic segment(s) thereby providing thermochromatic surface layers with a desired pattern.

13. A roadway marker with a thermochromatic adhesive backed sheeting comprising;

at least two preformed thermoplastic segments of said sheeting that includes top sides and bottom sides with an adhesive layer on said bottom sides of said thermoplastic segments;

and;

a protective sheet covering said adhesive layer on said bottom sides;

wherein said bottom sides and said protective sheets covering said adhesive layer of said bottom sides may be subsequently adhered to any suitable outdoor surface using at least pressure to provide adequate bond strength to ensure a proper permanent or semi-permanent or temporary surface covering said suitable outdoor surface and wherein the chemical composition of said adhesive is alkyl or butyl-based and wherein said top side is a thermochromatic, color indicative sheet or device that is bonded to a concrete or asphalt surface, a traffic sign, or a plate of a guidepost and upon which is indicated a surface temperature and;

a protective sheet for pressure sensitive adhesive only that covers said adhesive layer on said bottom sides.

14. The marker of claim 13, wherein said marker comprises a protective sheet covering and said protective sheet covering is comprised of primarily a silicone elastomer or other silicone based thermoplastic.

15. The marker of claim 13, wherein said marker comprises more than one preformed thermoplastic segments which can be matched with at least one other preformed thermoplastic segments such that said a thermochromatic surface layer provides a desired pattern.

16. A method for providing a thermochromatic adhesive backed sheeting comprising;

providing at least two preformed thermoplastic segments of said sheeting that includes top sides and bottom sides with an adhesive layer on said bottom sides of said thermoplastic segments;

and;

a protective sheet covering said adhesive layer on said bottom sides;

wherein said bottom sides and said protective sheets covering said adhesive layer of said bottom sides may be subsequently adhered to any suitable outdoor surface using at least pressure to provide adequate bond strength to ensure a proper permanent or semi-permanent or temporary surface covering said suitable outdoor surface and wherein the chemical composition of said adhesive is alkyl or butyl-based and wherein said top side is a thermochromatic, color indicative sheet or device that is bonded to a concrete or asphalt surface, a traffic sign, or a plate of a guidepost and upon which is indicated a surface temperature.

17. The method of claim 16, wherein said marker provided comprises a protective sheet and said protective sheet is comprised of primarily a silicone elastomer or other silicone based thermoplastic.

18. The method of claim 17, wherein said marker comprises more than one preformed thermoplastic segment which can be matched with at least one other preformed thermoplastic segment such that said a thermochromatic surface layer provides a desired pattern.

19. A system comprising providing an adhesive backed thermochromatic sheeting comprising;

at least two preformed thermoplastic segments of said sheeting that includes top sides and bottom sides with an adhesive layer on said bottom sides of said thermoplastic segments;

and;

a protective sheet covering said adhesive layer on said bottom sides;

wherein said bottom sides and said protective sheets covering said adhesive layer of said bottom sides may be subsequently adhered to any suitable outdoor surface using at least pressure to provide adequate bond strength to ensure a proper permanent or semi-permanent or temporary surface covering said suitable outdoor surface and wherein the chemical composition of said adhesive is alkyl or butyl-based and wherein said top side is a thermochromatic, color indicative sheet or device that is bonded to a concrete or asphalt surface, a traffic sign, or a plate of a guidepost and upon which is indicated a surface temperature.

20. The system of claim 19, wherein said thermochromatic sheeting comprises said protective sheet covering and said protective sheet covering is comprised of primarily a silicone elastomer or other silicone based thermoplastic.

21. The system of claim 19, wherein said thermochromatic sheeting comprises more than one preformed thermoplastic segment which can be matched with at least one other preformed thermoplastic segment such that said thermochromatic sheeting provides a desired pattern.

* * * * *